US007416493B2

(12) United States Patent
Carter

(10) Patent No.: US 7,416,493 B2
(45) **Date of Patent: *Aug. 26, 2008**

(54) GOLF TRAINING APPARATUS

(76) Inventor: Vandette B. Carter, 5 Granada Crescent, White Plains, NY (US) 10603

( * ) Notice: Subject to any disclaimer, the term of this patent is extended or adjusted under 35 U.S.C. 154(b) by 0 days.

This patent is subject to a terminal disclaimer.

(21) Appl. No.: 11/397,941

(22) Filed: Apr. 3, 2006

(65) Prior Publication Data

US 2006/0252569 A1 Nov. 9, 2006

Related U.S. Application Data

(63) Continuation-in-part of application No. 10/946,977, filed on Sep. 22, 2004, now Pat. No. 7,166,037.

(60) Provisional application No. 60/667,024, filed on Apr. 1, 2005, provisional application No. 60/504,626, filed on Sep. 22, 2003.

(51) Int. Cl.
*A63B 69/36* (2006.01)

(52) U.S. Cl. ..... 473/281; 473/165

(58) Field of Classification Search ..... 473/165, 473/172, 195, 280, 281, 284, 351, 575, 576, 473/579, 580, 586; 273/317, 348, 225; D21/708, D21/709

See application file for complete search history.

(56) References Cited

U.S. PATENT DOCUMENTS

| | | | | |
|---|---|---|---|---|
| 1,921,523 | A * | 8/1933 | Hart | 473/281 |
| 2,116,304 | A | 5/1938 | Crespin | 473/580 |
| 2,440,473 | A | 4/1948 | Hughes | 473/395 |
| 3,198,526 | A | 8/1965 | Smith et al. | |
| 3,404,892 | A * | 10/1968 | Pearce | 473/193 |
| 4,770,423 | A | 9/1988 | Pinske | |
| 4,776,596 | A | 10/1988 | Nojima | |
| 4,976,431 | A | 12/1990 | Guenther | 473/417 |
| 5,377,988 | A * | 1/1995 | Westman et al. | 473/281 |
| 5,403,006 | A | 4/1995 | Korte-Jungermann | |
| 5,513,847 | A | 5/1996 | Hu et al. | |
| 5,863,255 | A | 1/1999 | Mack | |
| 5,910,057 | A | 6/1999 | Quimby et al. | |
| D441,414 | S | 5/2001 | Polk, III | |
| 6,231,452 | B1 | 5/2001 | Novosel, Sr. | |
| 6,322,455 | B1 | 11/2001 | Howey | 473/168 |
| 7,166,037 | B2 * | 1/2007 | Carter | 473/281 |
| 2003/0148823 | A1 | 8/2003 | Nesbitt et al. | |

FOREIGN PATENT DOCUMENTS

| | | | |
|---|---|---|---|
| GB | 2244933 | A | 12/1991 |
| JP | 1-232980 | A | 9/1989 |
| JP | 1-236074 | A | 9/1989 |

* cited by examiner

*Primary Examiner*—Nini Legesse
(74) *Attorney, Agent, or Firm*—David Aker

(57) ABSTRACT

A training golf ball apparatus designed to imitate the realistic feel, weight, acoustic and flight characteristic of a real (regulation standard) golf ball, to allow a golfer to practice the sport in a realistic way safely at home, includes mechanized flights concealed within a cavity of the golf ball; a lightweight ball component and a magnetized tee. The device will perform as well as a standard golf ball; give accurate feedback on performance and promote realistic training in the home environment. The device provides the illusion that a lightweight golf ball is of standard weight when it is placed on a tee. For safety reason, the training golf ball apparatus changes aerodynamic properties once leaving the golf tee, and behaves as a lightweight, high aerodynamic drag object once airborne.

20 Claims, 6 Drawing Sheets

GOLF TRAINING APPARATUS

This application is a continuation-in-part of U.S. patent application Ser. No. 10/946,977 filed Sep. 22, 2004 now U.S. Pat. No. 7,166,037, which claims priority under 35 U.S.C. §119(e) from U.S. Provisional Patent Application Ser. No. 60/504,626 filed on Sep. 22, 2003, which is incorporated herein by reference in its entirety. This application also claims priority under 35 U.S.C. §119(e) from U.S. Provisional Patent Application Ser. No. 60/667,024 filed on Apr. 1, 2005, which is also incorporated herein by reference in its entirety.

BACKGROUND OF THE INVENTION

1. Field of the Invention

The present invention relates to apparatus that may be used to simulate certain aspects of the game of golf in a space-restricted environment. More particularly, it relates to those apparatus, for simulating the driving or chipping of a golf ball using a conventional swing of a golf club, without endangering persons or property in a reduced space environment.

2. Prior Art

Generally, there have been a variety of approaches to making games that use projectiles safer. In golf, there are many accomplished models that address the purpose of putting, but to date, other than the apparatus described in my above-mentioned U.S. patent application Ser. No. 10/946,977, there is no single device that can simulate, with great accuracy, the sound, feel and sight of being on a driving range. There are significant dangers and associated short falls of using a standard golf ball in a home setting. Space and safety are often the hindering factors that limit the practice of golf in a home or park environment. What is needed is an invention that utilizes a fraction of the space require for a driving range, but give real time analysis of playing on a course; without compromising the sight, sound, and feel of the sport.

SUMMARY OF THE INVENTION

It is an object of the invention to provide a golf training apparatus for the purpose of more realistically practicing pitching, chipping and hitting safely in a home setting.

It is a further object of the invention to provide apparatus that permits a determination to be made as to how far a standard golf ball would travel if hit by a golf club with the same force as used to hit a golf ball training apparatus in accordance with the invention.

It is another object of the invention to provide a golf ball training apparatus which exhibits a non-parabolic flight and with which real time feedback on distance, trajectory and angle of hitting a ball can be experienced.

To address and overcome the effects of using a golf ball or golf training apparatus of low weight, the apparatus uses a magnet to interact with a tee or other surface, to simulate the effect of gravity on a golf ball. The use of magnetic materials replicates the effect of a golf club hitting a standard weight golf ball perched on a tee.

Further, the golf ball training apparatus may have a built in electronic device and compatible unit (not shown in drawings) that will electronically determine the distance the ball has traveled. This can be seen as a LCD display or provided by a voice synthesis system. In other words, when the golf ball training apparatus is hit by a golf club, the distance traveled can be determine by a remote device that will locate the golf ball training apparatus and calculate its distance, angle of flight, etc.

These objects and others are achieved in accordance with the invention with a training golf ball apparatus comprising a generally spherically shaped body; a set of flights situated within the cavity of the body so as to be movable between a closed position and open position, the flights offering greater friction to travel through air in the open position than in the concealed, closed position; and a mechanism in the apparatus for maintaining the flights in the closed position until the ball is traveling through the air.

The training golf ball apparatus may be used in combination with a golf tee, the apparatus and golf tee interacting so that the mechanism maintains the flights in the closed position inside the cavity of the ball.

The mechanism may comprise a movable magnet or metallic material, and the golf tee may comprise a magnetic material for magnetic interaction with the movable magnetic/metallic material. The golf tee may also comprise an electromagnetic for providing at least a portion of a magnet field for magnetic interaction with the movable magnetic material.

The mechanism may comprise a movable body formed of a magnetic material; a set of one or more flexible flights wrapped around and within a cylindrical or drum portion within the movable body, the movable body and the flights being configured so that the set of flights are closed when the movable body is in a first position inside of the sphere of the ball and the set of flights are open when the movable body is in a second position extending from the sphere; and a biasing component for interaction with the movable body, so as to bias the movable body toward the second position; the set of flights being maintained in the closed position by interaction of the magnetic material and an external magnetic material positioned externally of the apparatus, the interaction serving to maintain the movable body in the first position as long as the external magnetic material is positioned in proximity to the apparatus.

The training golf ball apparatus may further comprise a transmitter disposed in the apparatus. The transmitter may transmit a signal for location of the apparatus. A receiver for the signal may have a facility for determining at least one of: how far the training golf ball apparatus is from the receiver, the trajectory of the training golf ball apparatus, the speed of training golf ball apparatus during flight, and the velocity vector of the training golf ball apparatus during flight.

The training golf ball apparatus may be used in combination with a set of flags, the set of flags having markings for simulated distance of flight of the apparatus.

The training golf ball apparatus may further comprise reinforcing zones associated with the outer periphery of the spherically shaped body.

The training golf ball apparatus may further comprise at least one component including a magnetic material at least partially disposed within the spherically shaped body so as to be able to interact with a magnetic material external to the body, in combination with a training mat. The training mat may have a magnetic material therein, the apparatus and the mat interacting so that the apparatus is attracted to the mat.

The training golf ball apparatus may be used in combination with a golf tee formed of a flexible spring-like material, so that the golf tee is not fractured when the training golf ball apparatus is hit with a golf club.

The training golf ball apparatus may further comprise a mechanism for limiting rate at which the flights move from the closed position to the open position. The mechanism for limiting the rate may comprise a friction device acting on a moving component of the mechanism for maintaining the flight in the closed position.

In accordance with another aspect of the invention, a training golf ball apparatus comprises a generally spherically shaped body; and at least one component including a magnetic material at least partially disposed within the spherically shaped body so as to be able to interact with a magnetic material external to the body. This training golf ball apparatus may also be used in combination with a training mat having a magnetic material therein sized, shaped and positioned so that the apparatus and the mat interact in a manner such that the apparatus is attracted to the mat.

This training golf ball apparatus may also be used in combination with a golf tee, the golf tee having a magnetic material, the apparatus and golf tee interacting so that the apparatus is attracted to the tee. The combination may further comprise an electromagnet disposed so as to influence strength of a magnetic field associated with the magnetic material in the tee. The combination may yet further comprise a source of electrical current for the electromagnet; and a control circuit for controlling direction and magnitude of current from the source flowing through the electromagnet.

In accordance with yet another aspect of the invention, a golf training system comprises a training golf ball apparatus having a weight lower than that of a standard golf ball and a device for increasing aerodynamic drag when the apparatus is in flight, and a set of flags, the set of flags having markings for simulated distance of flight of the apparatus.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
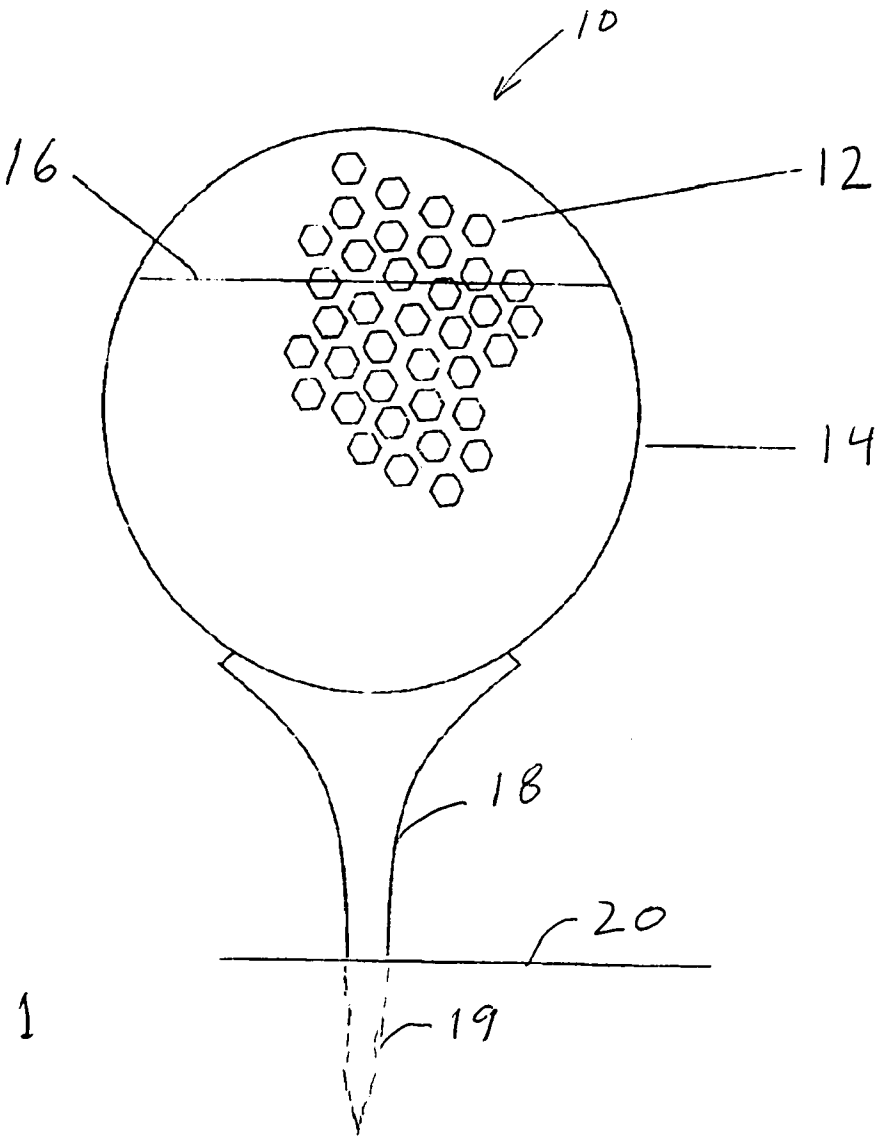
FIG. 1 is a side elevational view of a training golf ball in accordance with the invention situated on top of a golf tee.

Referring to FIG. 1, there is shown a side elevational view of apparatus incorporating features of the present invention. Although the present invention will be described with reference to the embodiments shown in the drawings and described, it should be understood that the present invention can be embodied in many alternate forms of embodiments as previously described in Provisional patent application 60/504,626. In addition, any suitable size, shape or type of elements or materials could be used. Also other application outside the realms of golf sports can be adapted for the usefulness of this device. For example the sport of baseball can greatly benefit from the invention.

In FIG. 1, a basic arrangement of a spherical object 10 is shown generally having a top housing portion 12, and a bottom housing portion 14, which are configured to mate along a circumferential line 16. Object 10 is disposed on an apparatus 18, which may be golf tee of a type described below and in U.S. patent application Ser. No. 10/946,977, that has an end 19 that is forced into the ground 20.

Figure 2:
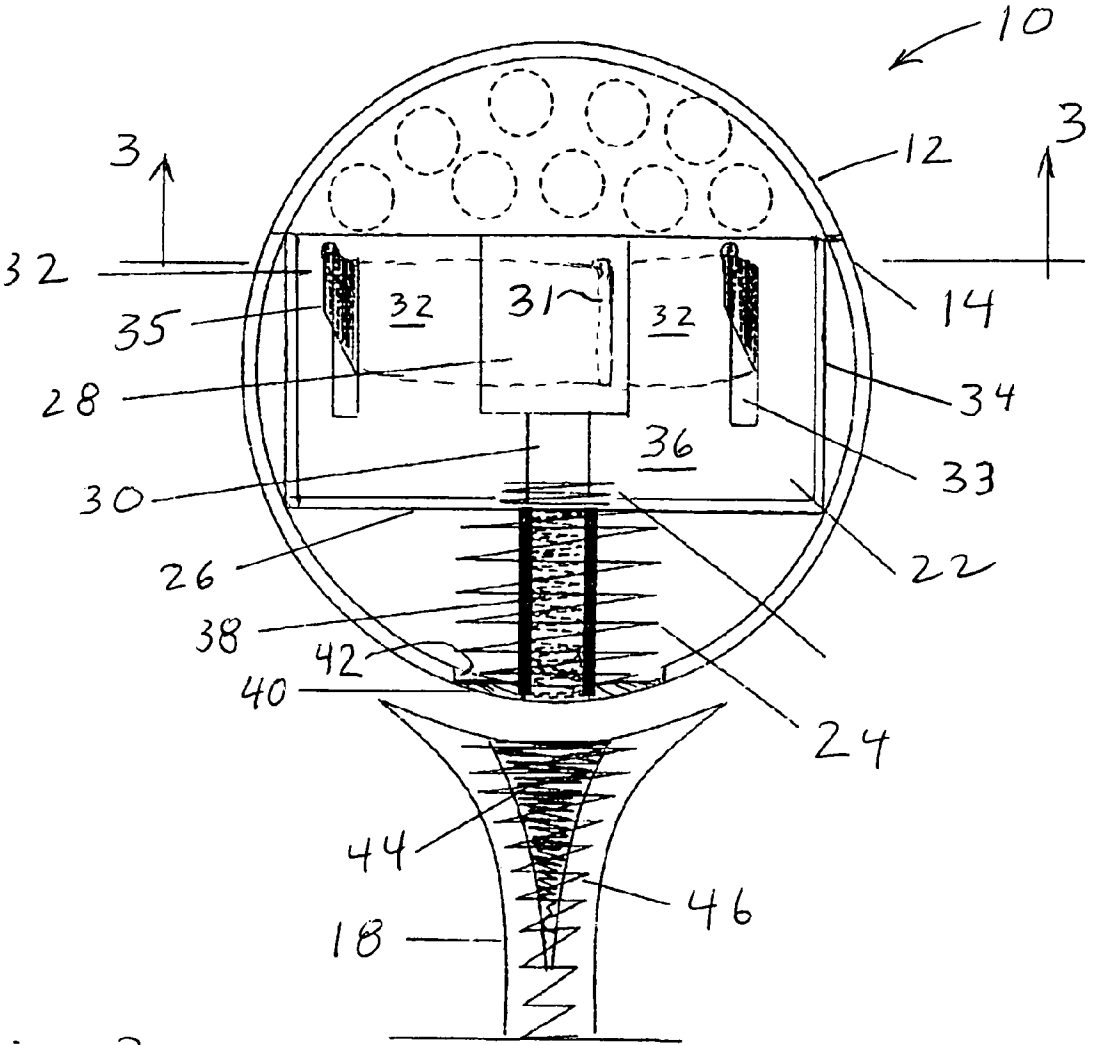
FIG. 2 is a cross-sectional view of the arrangement of FIG. 1.

Referring to FIG. 2, a cylindrical drum member 22 is disposed in second housing portion 14 for limited motion with respect to second housing portion 14. Absent any other forces acting on drum member 22, a spring 24 acts on a lower generally planar wall 26 of drum member 22, and causes it to move to a limited extent, so that a portion thereof extends from second housing portion 14, but drum member 22 does not completely leave second housing portion 14, as more fully explained below. Further, drum member 22 is constrained so that it may not rotate with respect to second housing portion 14, also as more fully described below.

Upper housing portion 12 is configured with a cylindrical extension portion 28 and a central tubular extension portion 30. Cylindrical extension portion 28 is configured with a plurality of openings 31 (preferably three openings 31), each opening for receiving and securing a first end of a respective flight 32, which extends through a corresponding respective opening 33 in the cylindrical wall 34 of drum member 22. Flights 32 have free ends with enlarged cylindrical portions 35 that are large enough so as to not fit though respective openings 33, thus preventing the flights 32 from being drawn entirely within drum member 22.

The inner wall of drum member 22, and cylindrical extension portion 28 of first housing portion 12 define between them a storage region 36 wherein flights 32 may be stored by being wound around cylindrical extension portion 28 due to relative rotation of first housing portion 12 with respect to the combination of drum member 22 and second housing portion 14.

Flights 32 are comprised of memory ribbon-like plastic materials which when wound inside of drum member 22 using a manual turning force, have a tendency to return to their unwound state, and extend fully from respective corresponding openings 33, as more fully described below with respect to FIGS. 4, 5 and 6. Flights 32 are vanes or protrusions which exhibit large amounts of friction when deployed from body 10, and greatly slow the speed and energy of object 10 as it travels through the air after being struck by, for example, the head of a golf club.

Central tubular portion 30 of first housing portion 12 extends through an opening in lower planar wall 26 of drum member 22, and has extending from its end a generally cylindrical magnetic material 38, such as a steel screw, with a head 40. Head 40 may be accessible through a hole 42 at the bottom of second housing portion 14.

Magnetic material 38, including head 40, is magnetically attracted to a magnetic material, such as a permanent magnet 44 within tee 18. Tee 18 may also be constructed with an internal reinforcing spring 46, or a means to strengthen or reduce the magnetic field produced by magnet 44, as more fully described in U.S. patent application Ser. No. 10/946,977.

As long as object 10 remains on tee 18, that is from a time it is placed on a surface having a magnetic interaction with magnetic material 38, until it is dislodged from the tee 18 or other surface having a magnetic material (such as by being struck with the head of a golf club), drum 22 remains entirely within second housing portion 14, and the flights are not deployed.

Figure 3:
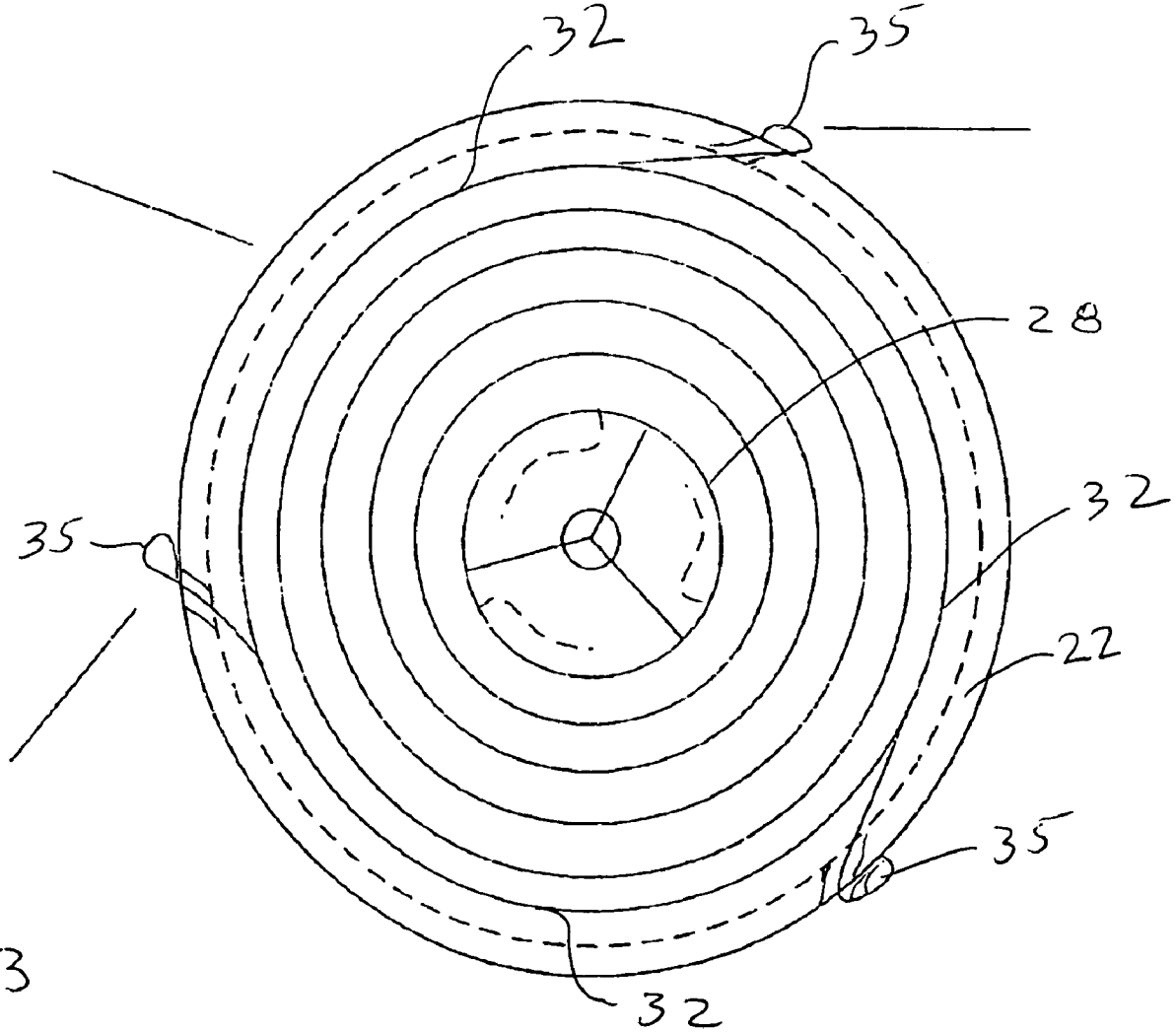
FIG. 3 is a schematic, partial cross-sectional view taken along line 3-3 of FIG. 2 showing the flights of the apparatus of FIG. 1 when positioned within the apparatus.

FIG. 3 is schematically representative of flights 32 being wound around cylindrical extension portion 28 of first housing portion 12, when the flights are stored within object 10. While the windings are shown as cylindrical for ease of illustration, it will be recognized that in fact they would be spiral in nature.

Figure 4:
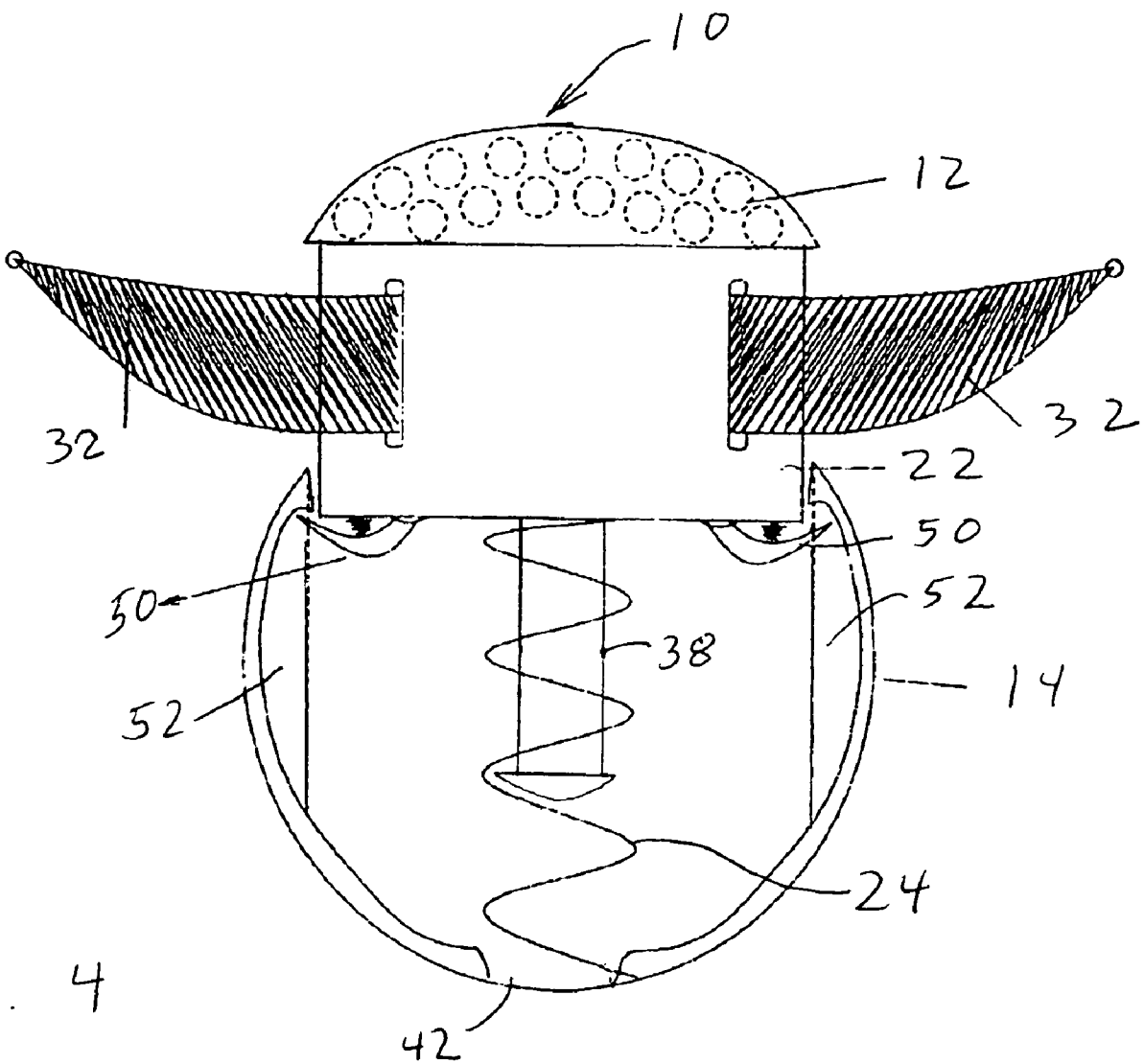
FIG. 4 illustrates the training golf ball of FIG. 2 in a functionally opened position with the flights being deployed.

FIG. 4 is a progression from FIG. 2 illustrating the training golf ball of FIG. 2 in a functionally opened position with the flights 32 being deployed from the storage region 36 (FIG. 2). As alluded to above, drum member 22 is prevented from rotating with respect to second housing portion 14, by a plurality of protrusions 50 (preferably three) extending into corresponding slots 52 in the inner wall of second housing portion 14. These protrusions may be simple ribs in the external surface of drum member 22 extending for a circumferential distance just less than that of respective slots 52, or more complex structures, as illustrated. To assist in assembly, these protrusions should be flexible enough, and of a size and shape that permits them to be "snapped into" their respective slots 52.

Flights 32 are tapered at ends not received in openings 31 in cylindrical extension portion 28 of the first housing portion 12 to assist in deploying the flights 32, as object 10 moves through the air after being struck.

Figure 5:
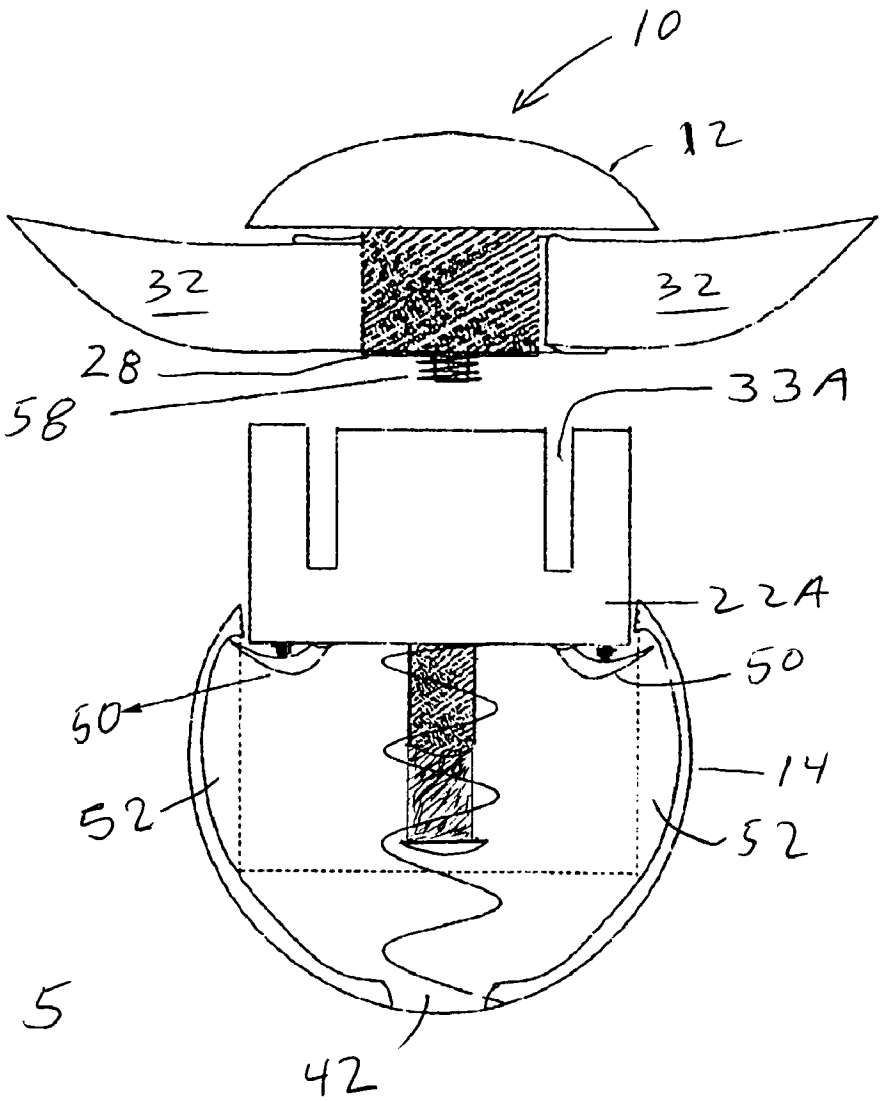
FIG. 5 is a partially exploded view of the apparatus as illustrated in FIG. 3.

Referring to FIG. 5, two additional features of the apparatus are illustrated. Instead of openings 33, in drum member 22A open-ended slots 33A are illustrated. Assembly is simplified because flights 32 may simply be dropped into slots 33A. In addition, although flights 32 may be sufficiently resilient and return to their unwound state with sufficient force to adequately deploy, a deployment assisting component, such as a coil spring 58 may be used to cause cylindrical extension portion 28 of first housing portion 12 to rotate with respect to drum member 22A (or drum member 22 of FIGS. 2, 3 and 4), thus aiding in the deployment of flights 32. An appropriate mechanism for controlling the speed of deployment of flights 32, whether or whether not a deployment assisting component is utilized, is of advantage in controlling the distance of flight of object 10 after it is struck. For greater distances, slow deployment is preferred, while rapid deployment results in short travel distances of object 10 after being struck. May be a simple friction fit of tubular extension 30 of first housing portion 12 within the opening in the lower wall of drum member 22 (or 22A) or other rotational motion damping device, as may be well known in the art.

Figure 6:
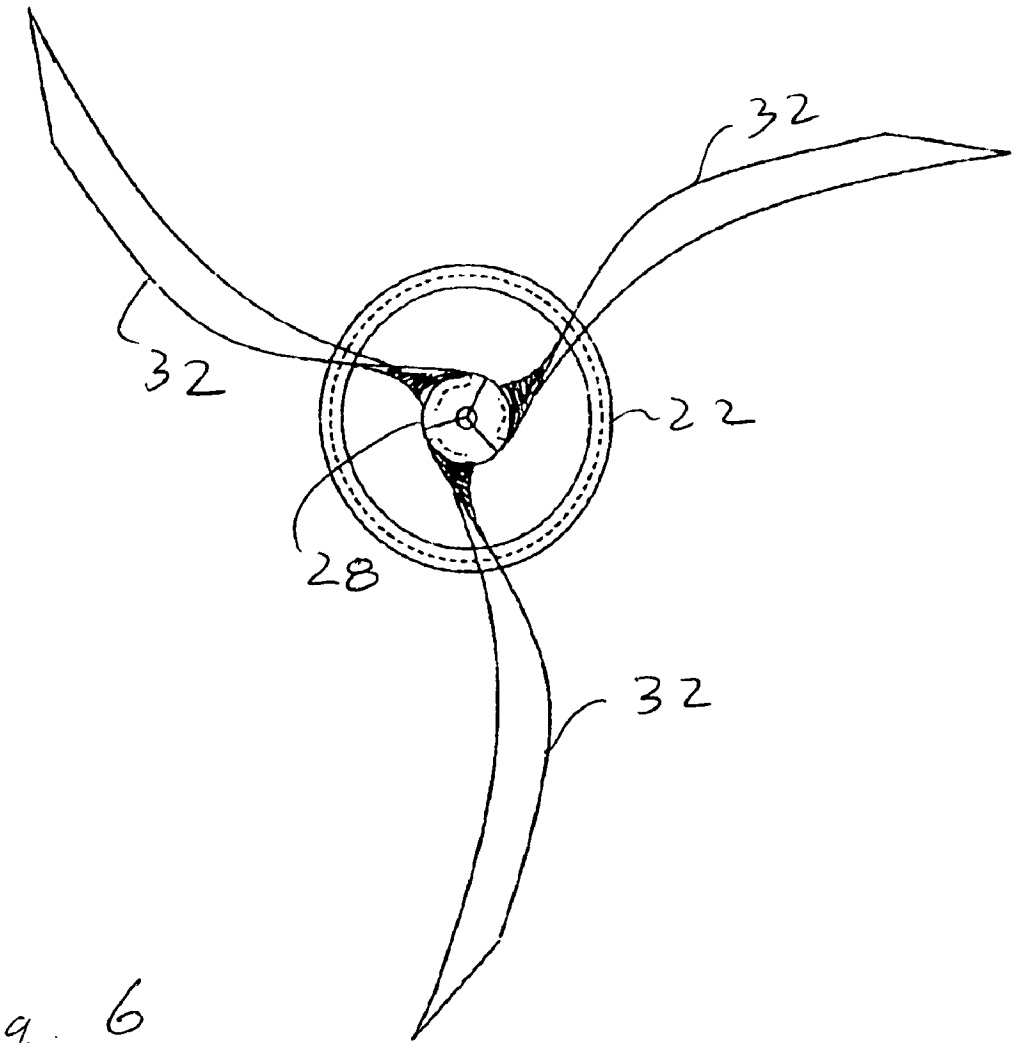
FIG. 6. is a partial plan view of the apparatus of FIG. 1 showing the flights in their fully deployed configuration.

FIG. 6 illustrates just the cylindrical extension 28 of first housing portion 12, drum member 22 (or 22A) and flights 32 when fully deployed. Full deployment of flights 22 creates very significant aerodynamic drag, thus rapidly slowing down object 10 as it travels through the air.

It is noted that by magnetic or by magnetically influenced, it is meant that a material is magnetized, may be magnetized, or is attracted by a magnetic field. When two such materials interact in the present invention, either one will be magnetized so that there is a magnetic force of attraction between them, or if both are magnetized, they will be positioned with respect to one another so as to be attracted to one another, so that, for example, a south magnetic pole of one magnetic faces a north magnetic pole of the other magnet (forming a bond).

Mode of Operation:

When an external force acts on the object 10, by striking with a golf club at any point, but preferably on the lower half, a series of events occur:

1.) The object becomes airborne obeying the laws of motion

2.)The cylindrical drum member 22 is moved upwards with respect to the lower portion or second housing portion 14, upon breaking away from the magnetic influence of the tee 18. By a regulatory device within the drum, the ribbon aerodynamic drag materials are released at a predetermined rate and length (depending on the distance desired or space restricting factors considered) . For instance, in order to make the object go further, the rate and length of the ribbon aerodynamic material is decreased. The opposite is done for the reverse effect.

3.) The object 10 remains airborne for a length of time based on climatic factors and the use of the deployed aerodynamic ribbons. The object will behave similar to a helicopter in flight once airborne.

4.) To reset the ball or object 10 to its original spherical shape, the top and bottom portions of the housing are held in a respective hand of the user and the top portion is given a full turn followed by a quarter turn in clockwise direction to spool the ribbons back into the cylindrical drum member 22. Enlarged cylindrical portions 35 prevent the flights 32 from being pulled completely into the drum member 22. Once the first action is accomplished, drum member 22 is then lowered gently into the cavity of the second housing portion 14. The two housing portions 12 and 14 are held tightly together due to the external magnetic influence of the tee 18.

5.) The former action is repeated to deploy the ball or object 10 once again off of the tee 18. The process is repeated each time a user intends to play the ball.

Regardless of the numerous engineering possible solutions, the goal is to secure the flights 22 inside the object or golf ball when the positioned on a surface having a magnetic material. An external force may facilitate the repositioning of the flights 22 into the ball or object 10. The flights will be deployed only when an external force acts on the object-golf ball.

The training golf ball apparatus may further comprise a mechanism for limiting the rate at which the flights move from the closed position to the open position as previously discussed. This mechanism may comprise a friction device acting on a moving component of the mechanism for maintaining the flights in the closed position, such as a cylindrical friction collar.

The outer circumference of the housing portions may be internally supplemented by thickness-increasing or reinforcing material (not shown) which may also serve as an acoustic enhancing medium to simulate the sound of impact with a golf club in addition to it primary goal of making the golf ball durable.

The tee 18 can be constructed of a flexible or sturdy material that is able to perform the task of supporting the object 10 in a vertical position. For the purpose of chipping practice, a flat surface version (not shown) of this described embodiment can be used to simulate pitching a ball from a level surface.

The object 10 may have disposed within, or located on or towards its perimeter, a transmitter for emitting a high frequency signal, which when received by a hand held receiver unit (not shown) can be used to determine the distance that the device has traveled and/or its location. In this regard, reference is made to U.S. Pat. No. 5,910,057, which is incorporated herein by reference in its entirety. Other parameters, such as speed, velocity vector, trajectory, and force of impact (with a suitable impact sensor, not shown) can be determined in this manner.

One of the magnetic materials can be magnetized as a result of an electric current flowing through a wire wrapped around the material, although this may be more appropriate for a tee than for an object that will be hit, and thus must be highly mobile. When the tee is magnetized in this fashion, the strength of the magnetic field may be adjusted by changing the magnitude of a current flowing through a coil (not illustrated), thereby controlling the force required to separate the golf ball training apparatus from the tee 4 and 5. A control unit having a battery and a current adjusting circuit may be provided for this purpose, so as to adjust both the magnitude and direction of the current. The magnitude of the current may be adjusted with a variable resistor or a rheostat operated with a knob. The direction of the current may be changed with a double pole double throw switch, having a center off position. The magnetic field generated by the electrical current may work in opposition to or in addition to a magnetic field generated by a permanent magnet within the tee, thus providing a default force of attraction when no current is utilized, and providing the ability to selectively and adjustably reduce or increase the magnetic field strength, and thus the attraction between the ball training apparatus or object 10 and the tee 18. The use of both a permanent magnet and an electromagnet may conserve battery life.

A tee in accordance with the invention may be constructed so as to resemble a conventional training mat found on a driving range. A planar magnetic material may be embedded is such a mat. Further, a variable height replaceable magnetic tee constructed for use with a training mat eliminates the need for embedding a tee into soil. The tee can be played from an uninterrupted flat surface.

Thus, it will be appreciated that in accordance with the invention, the characteristics of a standard golf ball may be simulated by an apparatus weighing less than the standard golf ball weight of 46.6 grams. This lower weight may be achieved by filler material being of relatively lower density material, or by providing hollow spaces in a somewhat denser material. Regardless of the manner in which such relatively lower weight is achieved, all of the danger and difficulties of using a standard golf ball in a home environment are overcome. A mere fraction of the space generally required to play golf is utilized, while providing the realistic sight, sound and feel of the sport. A golfer can eliminate the extra time required to travel to and from a driving range, and the expense of paying for its use, thus in effect saving up to thousands of dollars each year, while at the same time perfecting his or her driving skills in the comfort and convenience of a home environment.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A combination including a training golf ball apparatus, comprising:

a generally spherically shaped body;

a set of flights attached within said body so as to be movable between a closed position and open position, said flights offering greater friction to travel through air in said open position than in said closed position; and a mechanism in said apparatus for maintaining said flights in said closed position within said body until said ball is traveling through the air; and a golf tee, the apparatus and golf tee interacting so that said mechanism maintains said flights in said closed position; wherein said mechanism comprises a movable magnet material, and said golf tee comprises a magnetic material for magnetic interaction with said movable magnetic material.

2. The combination of claim 1, wherein said golf tee comprises an electromagnet, said electromagnet providing at least a portion of a magnet field for magnetic interaction with said movable magnetic material.

3. The combination of claim 1, wherein said mechanism comprises:

a movable body formed of a magnetic material;

a connection between said movable body and said flights arranged so that said set of flights are closed when said movable body is in a first position and said set of flights are deployed when said movable body is in a second position, said set of flights being maintained in said closed position by interaction with said moveable body and an external magnetic material positioned externally of said apparatus, said interaction serving to maintain said movable body in said first position as long as said external magnetic material is positioned in proximity to said apparatus to be influenced by a magnetic force.

4. The combination of claim 3, further comprising a cylindrical member in which coiling or wrapping of the flights within a cavity of the golf ball pertains until an external force acts on the surface of the device to deploy the flights outwards from within the cavity of the ball.

5. The combination of claim 1, further comprising a transmitter disposed in said apparatus, said transmitter transmitting a signal for location of said apparatus.

6. The combination of claim 5, in combination with a receiver for said signal, said receiver having a facility for determining at least one of: how far said training golf ball apparatus is from said receiver, the trajectory of said training golf ball apparatus, the speed of training golf ball apparatus during flight, and the velocity vector of said training golf ball apparatus during flight.

7. The combination of claim 1, wherein said golf tee is formed of a flexible material, so that the golf tee is not fractured when the training golf ball apparatus is hit with a golf club.

8. The combination of claim 1, further comprising a mechanism for limiting rate at which said flights move from said closed position to said open position.

9. The combination of claim 8, wherein said mechanism for limiting rate at which said flights move from said closed position to said open position comprises a friction device acting on a moving component of said mechanism for maintaining said flights in said closed position.

10. A combination including a training golf ball apparatus, comprising:

a generally spherically shaped body; and at least one component including a magnetic material at least partially disposed and movable within said spherically shaped body so as to be able to interact with and move with respect to said body, when influenced by a magnetic material external to said body; and a training mat having a magnetic material therein, said apparatus and said mat interacting so that said apparatus is attracted to said mat.

11. The combination of claim 10, further comprising:

a set of flights attached within said body so as to be movable between a closed position and open position, said flights offering greater friction to travel through air in said open position than in said closed position; and a mechanism in said apparatus for maintaining said flights in said closed position within said body until said ball is traveling through the air, and at least one component including said magnetic material at least partially disposed within said spherically shaped body so as to be able to move to interact with said training mat.

12. A combination including a training golf ball apparatus, comprising:

a generally spherically shaped body; and at least one component including a magnetic material at least partially disposed within said spherically shaped body so as to be able to interact with a magnetic material external to said body; and a golf tee, the golf tee having a magnetic material, said apparatus and golf tee interacting so that said apparatus is attracted to said tee.

13. The combination of claim 12, further comprising an electromagnet disposed so as to influence strength of a magnetic field associated with said magnetic material in said tee.

14. The combination of claim 13, further comprising:

a source of electrical current for said electromagnet; and a control circuit for controlling direction and magnitude of current from said source flowing through said electromagnet.

15. The combination of claim 14, wherein said golf tee is formed of a flexible material, so that the golf tee is not fractured when the training golf ball apparatus is hit with a golf club.

16. A training golf ball apparatus, comprising:

a first generally spherical housing portion having a cylindrical extension portion and a tubular extension portion;

a second generally spherical housing portion mating with said first housing portion;

a movable generally cylindrical member disposed for limited motion within said first housing portion, said member having an opening for rotationally receiving said tubular extension portion of said first housing portion and an inner cylindrical surface defining a storage region between said inner cylindrical surface and said cylindrical extension portion of said first housing portion;

a plurality of flights made of a flexible, resilient material, first ends of said flights being in openings in said cylindrical extension portion of said first housing portion, and the flights extending through corresponding openings in said member, said flights being sized and shaped for storage in said storage region by being wound around said cylindrical extension portion due to rotation of said first housing portion with respect to said second housing portion;

a magnetic material received within said second housing portion as an extension of said tubular extension portion of said first housing portion;

a spring for biasing said member so that said member is forced away from said second portion of said housing, said spring having an elastic characteristic allowing it to remain compressed when said magnetic material is acted upon by another magnetic material external to said second portion of said housing;

said flexible resilient nature of said flights causing said flights to unwind and deploy through said corresponding openings in said cylindrical member, when said apparatus is removed from said magnetic material external to said second portion of said housing, and said spring forces said cylindrical member to extend from said second housing portion.

17. The apparatus of claim 16, further comprising:

a flight deployment means for biasing said first housing portion to rotate about said tubular extension portion so that portions of said flights which are disposed in said flight storage portion are assisted in moving through said corresponding openings to deploy said flights, when said spring causes said portion of said cylindrical member to extend from said second housing portion.

18. The apparatus of claim 17, wherein said flight deployment means comprises a coil spring.

19. The apparatus of claim 16, wherein said flights are tapered at ends not received in said openings in said cylindrical extension portion of said first housing portion to assist in deploying said flights, as said apparatus moves through air when struck.

20. A training golf ball apparatus, comprising:

a first generally spherical housing portion;

a second generally spherical housing portion mating with said first housing portion;

a generally cylindrical member disposed within said first housing portion, said member having an inner cylindrical surface defining a storage region surrounding said inner cylindrical surface within said first housing portion;

a plurality of flights made of a flexible, resilient material, first ends of said flights being in said storage region, said flights being sized and shaped for storage in said storage region by being wound in said storage region due to rotation of said first housing portion with respect to said second housing portion;

a magnetic material received within said second housing portion as an extension of said first housing portion; and a spring for biasing said first housing portion away from said second housing portion, said spring having an elastic characteristic allowing it to remain compressed when said magnetic material is acted upon by another magnetic material external to said second housing portion;

said flexible resilient nature of said flights causing said flights to unwind and deploy through openings in said first housing portion, when said apparatus is removed from said magnetic material external to said second housing portion, and said spring forces said first housing portion to move with respect to said second housing portion.

* * * * *